United States Patent [19]

Tanaka et al.

[11] Patent Number: 4,634,023

[45] Date of Patent: Jan. 6, 1987

[54] CONTAINER

[75] Inventors: Yoshinobu Tanaka, Minoo, Japan; Hiromitsu Yokoi, Torrance, Calif.

[73] Assignee: Kabushiki Kaisha Alpha Giken, Osaka, Japan

[21] Appl. No.: 693,430

[22] Filed: Jan. 22, 1985

[30] Foreign Application Priority Data

Jan. 25, 1984 [JP] Japan ..... 59-11664

[51] Int. Cl.[4] ..... B65D 35/56

[52] U.S. Cl. ..... 222/105; 222/214

[58] Field of Search ..... 222/92, 105, 95, 107, 222/206, 215, 214, 420, 182; 604/202, 234

[56] References Cited

U.S. PATENT DOCUMENTS 3,081,002 3/1963 Tauschinski et al. ..... 222/105

3,873,003 3/1975 Seiferth et al. ..... 222/105

4,067,499 1/1978 Cohen ..... 222/105

4,392,491 7/1983 Takasugi et al. ..... 604/202

*Primary Examiner*—Joseph J. Rolla

*Assistant Examiner*—Kenneth Noland

*Attorney, Agent, or Firm*—Armstrong, Nikaido, Marmelstein & Kubovcik

[57] ABSTRACT

A container comprising an outer casing 1 having a base-side opening and a front-side opening, an inner container 2 fitted in said outer casing 1 for containing liquid therein and having a nozzle at the front end thereof, said inner container 2 having a resilient structure portion, and a support member 3 which is in engagement with or fitted in said outer casing 1 at the rear of said inner container 2. By repeating the application of finger pressure to the support member 3 n times it is possible to allow n drops of liquid to drop accurately.

3 Claims, 13 Drawing Figures

CONTAINER

BACKGROUND OF THE INVENTION

The present invention relates to containers for containing fluid materials and, more particularly, to a container serving as an applicator for an instant adhesive.

A container for a cyanoacrylate-based adhesive is known such that the container, of the type having flexibility and a nozzle and having an adhesive contained therein, is adapted to discharge adhesive through the nozzle onto an application surface by depressing the container body as held between fingers after the tip of the nozzle is opened. However, such container has a disadvantage that the amount of discharge is controlled only by finger hold so that several drops of adhesive may be discharged at a time unless precise care is used in timing the finger push and controlling pressure application.

An adhesive application tool is also known which is of the type having an injector-like device and a cartridge-form adhesive container inserted therein (U.S. Pat. No. 4,392,491, for example). This tool also has a difficulty in that the amount of piston insertion into the cylinder is controlled by finger so that several drops of adhesive may be discharged at a time unless good care is used in the exercise of finger control.

An object of this invention is to provide a container suitable for containing a fluid material and, more particularly, a container which can serve as an applicator for an instant adhesive.

Another object of the invention is to provide a container which permits discharge of a single drop of liquid by one finger-push.

These and other objects of the invention will become apparent in the detailed description which follows.

SUMMARY OF THE INVENTION

The above mentioned difficulty with the conventional adhesive container and/or adhesive application tool has now been overcome and the objects of the invention can be attained by providing a new container comprising an outer casing having a base-side opening and a front-side opening and not deformable by rail pressure, an inner container fitted in said outer casing for containing liquid therein and having a nozzle at the front end thereof, said inner container having a resilient structure portion that it is depressed inwardly by an external pressure applied to the base-side portion thereof but is restored to its original shape when the pressure is removed, and a support member which is in engagement with or fitted in said outer casing at the rear of said inner container to hold the inner container in the outer casing, said support member having a pressure portion for compressing the inner container at the base side thereof when a finger push is applied from behind and a resilient structure portion for allowing the inner container to restore its original position, whereby a single finger-push applied from behind the support member allows the inner container to discharge one drop of liquid out of its content through the front end of the nozzle.

DETAILED DESCRIPTION OF THE INVENTION

Figure 1:
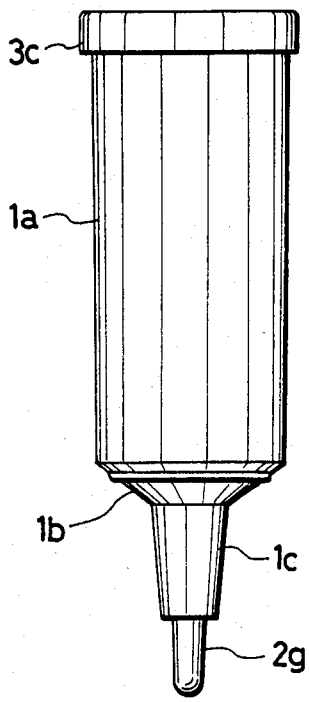
FIG. 1 is a front view showing one embodiment of the invention.

While this invention is susceptible of embodiment in many different forms, there is shown in the drawings and will herein be described in detail a prefered embodiment of the invention with the understanding that the present disclosure is to be considered as an exemplification of the principles of the invention and is not intended to limit the invention to the embodiments illustrated.

The Examples of the present invention will be described in detail with reference to the drawings as follows:

EXAMPLE 1

Figure 4:
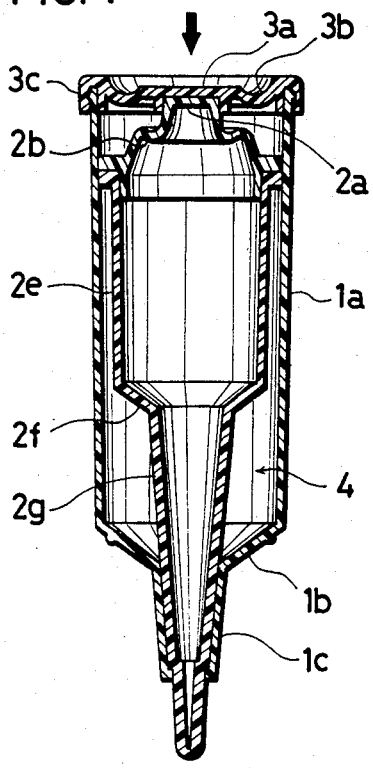
FIG. 4 is a longitudinal sectional view of the embodiment of FIG. 1.
Figure 2:
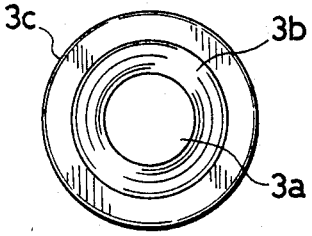
FIG. 2 is a plan view thereof.
Figure 3:
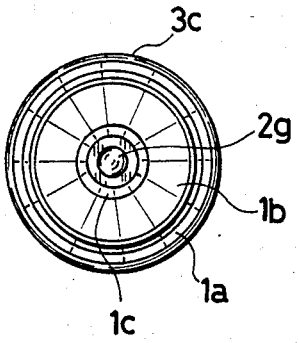
FIG. 3 is a bottom view thereof.
Figure 5:
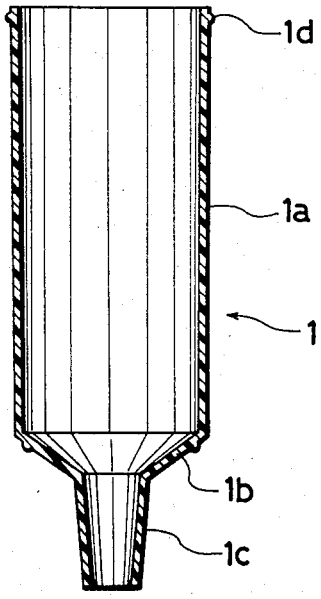
FIG. 5 is a longitudinal sectional view showing an outer casing.
Figure 6:
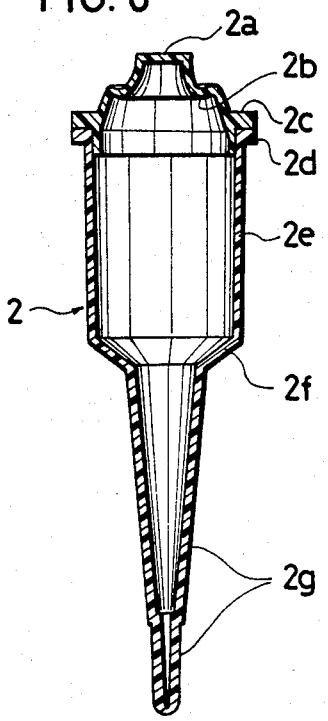
FIG. 6 is a longitudinal section of an inner container.
Figure 7:
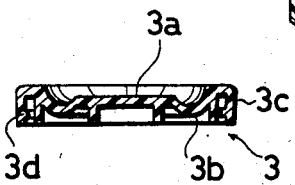
FIG. 7 is a longitudinal section of a support member.

FIG. 1 is a front view showing an embodiment of the invention; FIG. 2 is a plan view thereof; and FIG. 3 is a bottom view thereof. It is to be noted that a rear view, a right side view, and a left side view, of the embodiment are identical with the front view shown in FIG. 1. FIG. 4 is a longitudinal view in section of the embodiment of FIG. 1. FIG. 5 is a longitudinal section of an outer casing. FIG. 6 is a longitudinal section of an inner container. FIG. 7 is a longitudinal section of a support member.

Numeral 1 designates an outer casing, which is preferably of an opaque tone for light screening purposes. As shown is longitudinal section in FIG. 5, the outer casing 1 comprises a body 1*a*, a shoulder 1*b*, and a nozzle support 1*c*. The body 1*a* and nozzle support 1*c* are slightly tapered so that they are reduced in diameter toward their respective forward ends. The shoulder 1*b* is slanted at about 40° so that it can serve as a finger support during adhesive discharge operation. The body 1*a* has an engagement ledge 1*d* formed on the outer periphery of its base-side portion.

Numeral 2 designates an inner container, which preferably is transparent to provide a vision-through of its content. As shown in longitudinal section in FIG. 6, the inner container 2 comprises a base-side block 2A and a front-side block 2B, with a space surrounded by the blocks 2A and 2B for containment of such fluid material as an instant adhesive. The blocks 2A and 2B are bonded together at a flange portion 2*c* of the former and a flange portion 2*d* of the later by ultrasonic bonding or the like means. If so desired, the flange portions 2*c* and 2*d* may be fitted together and not bonded.

The base-side block 2A has a raised portion 2*a* and a bent portion 2*b*. The front-side block 2B has a body portion 2*e* and a shoulder portion 2*f*. Shown by 2*g* is a nozzle having a double-stage construction. The raised portion 2*a* is deformable inwardly by an external pressure exerted thereon, but is allowed to return to its original condition by elastic recovery through the bent portion 2*b* when the pressure is removed.

Numeral 3 designates a support member 3, which preferably is opaque for light screening purposes. As shown in longitudinal section in FIG. 7, the support member 3 comprises a presser portion 3*a*, a bent portion 3*b*, and an edge portion 3*c*. The presser portion 3*a* is adapted to move in the direction of the arrow in FIG. 4 if force is entered thereon in that direction and to return to its original condition by elastic recovery through the bent portion 3*b* when the force is removed. The edge portion 3*c* has an engagement ledge 3*d*.

When the inner container 2 is fitted into the outer casing 1 from the base side thereof, the outer periphery of nozzle 2*g* of the inner casing 2 goes in contact with the inner periphery of nozzle support 1*c* of the outer casing 1, and the outer edges of flange portions 2*c*, 2*d* of the inner container 2 goes in contact with the inner wall of body 1*a* of the outer casing 1*a*, the inner container 2 being thus housed in the outer casing 1 to stability. Between the outer casing 1 and the inner container 2 there is formed a cavity 4, into which a drying agent or adsorbent such as active carbon or silica gel may be contained as required.

Nextly, from behind the inner container 2 the edge portion 3*c* of the support member 3 is pushed onto the base-side edge of body 1*a* of the outer casing 1, whereupon the ledge 1*d* on the body 1*a* of the casing 1 is brought in engagement with the ledge 3*d* on the edge portion 3*c* of the support member 3, so that the support member 3 is fixed to the outer casing 1, the presser portion 3*a* of the support member 3 being in light contact with the raised portion 2*a* of the inner container 2.

In actual use, the nozzle 2*g* of the inner container 2 is first opened at its tip by means of a pin or cutter, and subsequently, the body 1*a* of the outer casing 1 is held with the thumb and the second and third fingers (or between the first and second fingers in manner as a cigarette is held), with the nozzle 2*g* held downward as shown in FIG. 1 or FIG. 4, and the presser portion 3*a* of the support member 3 is pressed inwardly with the inner surface of the first finger (or of the thumb). By such finger action the presser portion 3*a* of the support member 3 is moved toward the inner container 2 to depress the raised portion 2*a* of the inner container 2. Thus, the interior of the inner container 2 is compressed so that one drop of the adhesive is allowed to drop from the front end of the nozzle 2*g*. If pressing by finger is stopped, the presser portion 3*a* is allowed to retreat by virtue of elastic recovery through the bent portion 3*b* of the support member 3, and accordingly the raised portion 2*a* of the inner container 2 is allowed to return to its original condition by virtue of elastic recovery through the bent portion 2*b*, with the results that an adhesive drop let appearing at the tip of the nozzle 2*g* is retracted by negative pressure into the inner container 2. By repeating the application of finger pressure to the support member 3 n times is it possible to allow n drops of adhesive to drop accurately. In this way the present invention permits an accurate discharge of one drop of the content through one time pressing action, or in other words, one push one drop, which is the most outstanding advantage of the container according to the invention.

In the above described container, it is possible of course to attach a capillary nozzle to the front end of the opened nozzle 2*g* so as to provide a smaller drop of adhesive or to facilitate a more neat adhesion.

EXAMPLE 2

Figure 9:
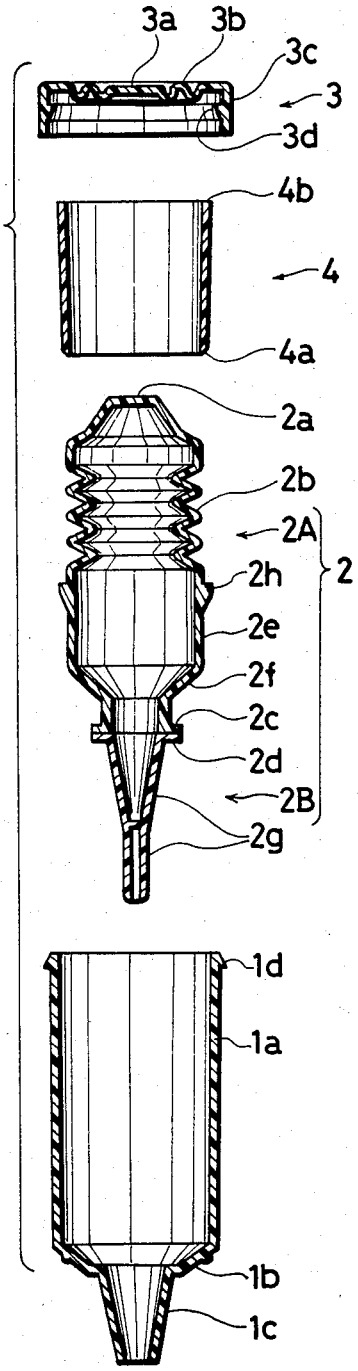
FIG. 9 is an exploded view thereof.
Figure 8:
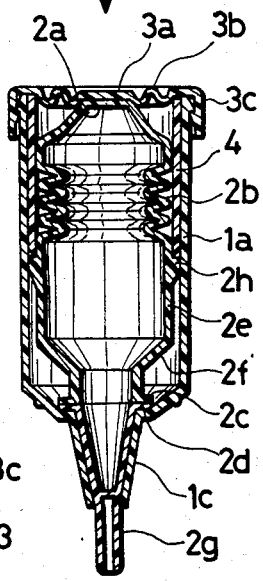
FIG. 8 is a longitudinal sectional view showing another embodiment of the invention.

FIG. 8 is a longitudinal section showing another embodiment of the invention, and FIG. 9 is an exploded view thereof.

Numeral 1 designates an outer casing which comprises a body 1*a*, a shoulder 1*b*, and a nozzle support 1*c*. On the base-side outer periphery of the body 1*a* there is provided an engagement ledge 1*d*.

Numeral 2 is an inner container which comprises a base-side block 2A and a front-side block 2B, with a space surrounded by the blocks 2A and 2B for containment of a fluid material such as an instant adhesive. The blocks 2A and 2B are bonded together at a flange portion 2*c* of the former and a flange portion 2*d* of the latter by ultrasonic bonding or the like means. Numeral 2*a* is a raised portion of the base-side block 2A, and 2*b* is a bellows-shaped multi-stage bent portion. Numeral 2*e* is a body portion, and 2*f* is a shoulder portion. Shown by 2*h* is a ledge-like projection formed on the body portion 2*e*. Shown by 2*g* is a nozzle having a two-stage construction. The raised portion 2*a* is deformable inwardly by an external pressure exerted thereon, but is allowed to restore its original condition by elastic recovery through the bent portion 2*b* when the pressure is removed.

Numeral 3 is a support member which comprises a presser portion 3*a*, a bent portion 3*b*, and an edge portion 3*c*. The presser portion 3*a* is adapted to move in the direction of the arrow in FIG. 8 if force is exerted thereon in that direction and to return to its original condition by elastic recovery through the bent portion 3*b* when the force is removed. The edge portion 3*c* has an engagement ledge 3*d*.

Shown by 4 is an inner ring which may be provided, as required, for insertion between the inner container 2 and the outer casing 1.

The function of the inner ring 4 is to prevent the raised portion 2*a* of the inner container 2 from being subjected to pressure when an axial pressure is exerted on the nozzle 2*g*, at the time of or after nozzle opening, thus preventing the content of the inner container 2 from being discharged from the front end of the nozzle 2*g*. One end 4*a* of the inner ring 4 is in abutment with the ledge-like projection 2*h* on the body portion 2*e* of the inner container 2 and the other end 4*b* of the inner ring 4 is in abutment with the support member 3; accordingly, if an axial pressure is exerted on the nozzle 2*g*, the bellows-shaped bent portion 2*b* of the inner container 2 is subjected to no pressure, thus no part of the content being discharged.

EXAMPLE 3

Figure 10:
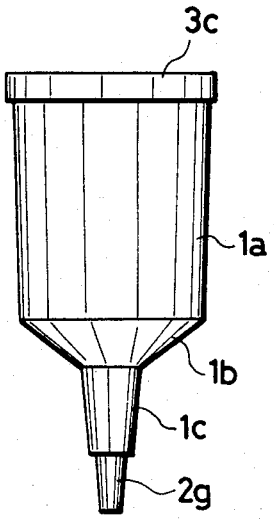
FIG. 10 is a front view showing a further embodiment of the invention.
Figure 11:
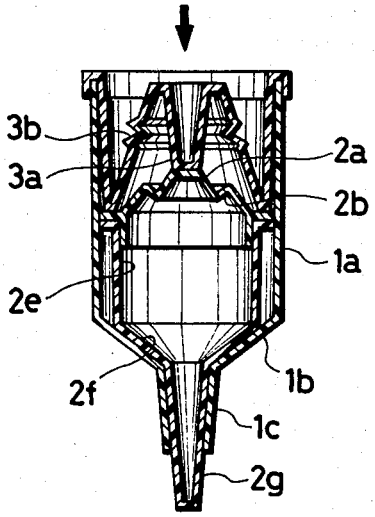
FIG. 11 is a longitudinal section thereof.

FIG. 10 is a front view showing a further embodiment of the invention; FIG. 11 is a longitudinal section thereof; and FIG. 12 is an exploded view thereof.

Figure 12:
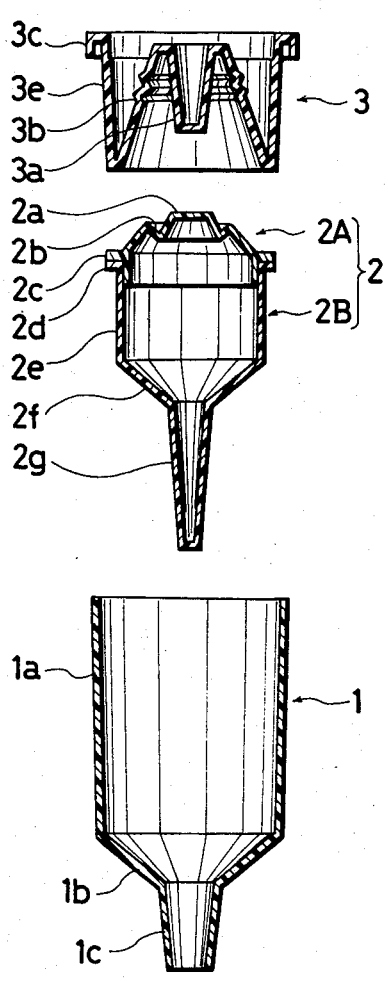
FIG. 12 is an exploded view thereof.

Numeral 1 designates an outer casing which, as the exploded view in FIG. 12 illustrates, comprises a body 1*a*, a shoulder 1*b*, and a nozzle support 1*c*.

Numeral 2 designates an inner container which, as the FIG. 12 exploded view shows, a base-side block 2A and a front-side block 2B. The blocks 2A and 2B are integrated into one unity through bonding of their respective flange portions 2*c* and 2*d*. A fluid material such as an instant adhesive is contained in a space surrounded by the blocks 2A and 2B. Shown by *2a* is a raised portion formed on the base-side block 2A, and shown by *2b* is a bent portion. Numeral *2e* is a body portion of the front-side block 2B, and *2f* is a shoulder portion. Shown by *2g* is a nozzle. The raised portion *2a* is deformable inwardly by an external pressure exerted thereon, but is allowed to return to its original condition by elastic recovery through the bent portion *2b* when the pressure is removed.

Numeral 3 is a support member which, as the FIG. 12 exploded view shows, comprises a presser portion *3a*, a bent portion *3b*, an edge portion *3c*, and a peripheral portion *3e*. The presser portion *3a* is adapted to move in the direction of the arrow in FIG. 11 if force is exerted thereon in that direction and to return to its original condition by elastic recovery through the bent portion *3b* when the force is removed.

In the container of the present invention, the raised portion *2a* of the inner container 2 and the presser portion *3a* of the support member 3 may be bonded together so that the inner container 2 and the support member 3 are made integral.

Any material such as metal, plastics, glass or the like may be suitably selected for the construction of the outer casing 1, inner container 2, support member 3, and inner ring 4. If the liquid to be contained is likely to change in property when exposed to light, it is desirable that an opaque material be used for the outer casing 1 and support member 3 and that a transparent or semi-transparent material be used for the inner container 2.

The bent portion *2b* of the inner container 2 may be of a one-stage construction or may be of a multi-stage bellows-like construction. In any case, the inner container 2 should be of such construction that it is depressed inwardly by an external pressure against the base-side portion thereof but is restored to its original condition when the pressure is removed.

Figure 13:
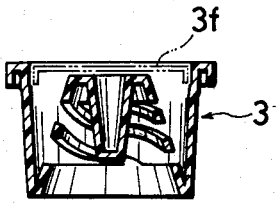
FIG. 13 is a longitudinal section showing another from of support member.

In Example 3, the bent portion *3b* of the support member 3 is of a bellows-like form; but as in FIG. 13 in which a different form is shown, it may be of a spiral form to provide resiliency. In any way, the support member 3 should be of such construction that it has a presser portion for depressing the base-side portion of the inner container 2 from behind when a finger pressure is applied, and a resilient structure portion for restoring the inner container 2 to a non-depressed position when the finger pressure is removed. Further, where the support member 3 has a spiral portion as shown in FIG. 13, it is desirable to provided a light-screening opaque layer *3f*, as shown by a two-dot chain line in FIG. 13, to prevent the entry of light rays through the spiral portion.

Constructed as above described, the container according to the invention has the following advantages:

(1) Accurate one-drop discharge of liquid by one finger push can be assured.

(2) Droplets, if any, present at the tip of the nozzle may be retracted into the nozzle by negative pressure when finger push is removed. Therefore, the trouble of unexpected liquid dropping can be avoided.

(3) Deterioration by light of the liquid content can be avoided by using a light-screening material for the outer casing 1. Further, the presence of support member 3 behind the inner container 2 fitted in the outer casing 1 assures complete shut-off of light from entry into the liquid content of the inner container 2, if it is also constructed of a light-screening material.

(4) By incorporating an inner ring 4 it is possible to prevent the discharge of liquid from the nozzle, even if any axial pressure is exerted during or after nozzle opening.

(5) The container can be easily assembled by simple fitting and engaging together.

(6) Simple overall configuration assures ease of use and adds to convenience of handling, storing and packing.

(7) The inner container 2 is replaceable in the form of a cartridge, when it is emptied of its content.

The container according to the invention is useful as an applicator for an instant adhesive in particular. It can also be used for various other container purposes, e.g., for all sorts of adhesives and fluid materials (in liquid or paste form) such as drugs, diagnosticums, inspection agents, electronic component sealers, and spices.

What is claimed is:

1. A container comprising an outer casing having a base-side opening and a front-side opening and not deformable by rail pressure, an inner container fitted in said outer casing for containing liquid therein and having a nozzle at the front end thereof, said inner container having a resilient structure portion that it is depressed inwardly by an external pressure applied to the base-side portion thereof but is restored to its original shape when the pressure is removed, a support member which is in engagement with or fitted in said outer casing at the rear of said inner container to hold the inner container in the outer casing, said support member having a pressure portion for compressing the inner container at the base side thereof when a finger push is applied from behind and said support member further having a resilient structure portion for allowing the inner container to restore its original position, and an inner ring between said outer casing and said inner container, one end of said inner ring abutting a ledge formed on the inner container at a location nearer to the nozzle than from the resilient structure portion and the other end thereof abutting the support member, whereby a single finger-push applied from behind the support member allows the inner container to discharge one drop of liquid out of its content through the front end of the nozzle.

2. The container according to claim 1 wherein said resilient structure portion of the inner container comprises a single-stage bent portion formed on the inner container.

3. The container according to claim 1 wherein said resilient structure portion of the inner container comprises a bellows-shaped multi-stage bent portion formed on the inner container.

* * * * *